US008380103B2

(12) United States Patent
Souda

(10) Patent No.: US 8,380,103 B2
(45) Date of Patent: Feb. 19, 2013

(54) IMAGE FORMING APPARATUS HAVING PHOTOSENSITIVE MEMBER UNIT THAT MOVES BETWEEN AN OUTER POSITION AND AN OPERATIONAL POSITION

(75) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 369 days.

(21) Appl. No.: 12/724,745

(22) Filed: Mar. 16, 2010

(65) Prior Publication Data

US 2010/0329757 A1 Dec. 30, 2010

(30) Foreign Application Priority Data

Jun. 30, 2009 (JP) ..... 2009-154850

(51) Int. Cl.
*G03G 15/00* (2006.01)
*G03G 21/16* (2006.01)

(52) U.S. Cl. ..... 399/110; 399/112

(58) Field of Classification Search ..... 399/110, 399/112, 116, 111
See application file for complete search history.

(56) References Cited

U.S. PATENT DOCUMENTS

| | | | | |
|---|---|---|---|---|
| 6,006,058 | A | 12/1999 | Watanabe et al. | |
| 6,029,032 | A | 2/2000 | Watanabe et al. | |
| 6,169,866 | B1 | 1/2001 | Watanabe et al. | |
| 6,324,363 | B1 | 11/2001 | Watanabe et al. | |
| 6,330,409 | B1 | 12/2001 | Watanabe et al. | |
| 7,720,405 | B2 | 5/2010 | Okabe | |
| 7,761,024 | B2 * | 7/2010 | Imaizumi et al. | 399/112 X |
| 7,890,013 | B2 | 2/2011 | Okabe | |
| 7,945,184 | B2 | 5/2011 | Takagi | |
| 2006/0269313 | A1 | 11/2006 | Takagi | |
| 2007/0147885 | A1 | 6/2007 | Okabe et al. | |
| 2007/0286632 | A1 | 12/2007 | Okabe | |
| 2008/0181658 | A1 * | 7/2008 | Okabe | 399/111 |
| 2008/0292355 | A1 * | 11/2008 | Sakurai et al. | 399/110 |
| 2009/0202271 | A1 | 8/2009 | Okabe et al. | |
| 2010/0178076 | A1 | 7/2010 | Okabe | |
| 2011/0076050 | A1 | 3/2011 | Okabe | |

FOREIGN PATENT DOCUMENTS

JP 08-254862 A 10/1996

(Continued)

OTHER PUBLICATIONS

JP Office Action dtd Apr. 19, 2011, JP Appln. 2009-154850, English translation.

(Continued)

*Primary Examiner* — Sophia S Chen
(74) *Attorney, Agent, or Firm* — Banner & Witcoff, Ltd.

(57) ABSTRACT

An electrophotographic image forming apparatus may include a main body including a reference protrusion having a reference surface on one side and a pressing member on the other side, and a photosensitive member unit configured to move between an operational position and an outer position. The photosensitive member unit stops at a particular position located between the outer position and the operational position. The reference surface of the main body may contact the photosensitive member unit located in the operational position. The pressing device of the main body may be configured to press the photosensitive member unit toward the reference surface when the photosensitive member unit is located in the particular position and in the operational position.

32 Claims, 13 Drawing Sheets

FOREIGN PATENT DOCUMENTS

| | | | |
|---|---|---|---|
| JP | 10-153937 | A | 6/1998 |
| JP | 10-153942 | A | 6/1998 |
| JP | 10-239933 | A | 9/1998 |
| JP | 2005-107109 | A | 4/2005 |
| JP | 2006-184901 | A | 7/2006 |
| JP | 2006-330620 | A | 12/2006 |
| JP | 2007-178657 | A | 7/2007 |
| JP | 2007-264469 | A | 10/2007 |

OTHER PUBLICATIONS

JP Notice of Reasons for Rejection dated Dec. 20, 2011, corresponding Application No. 2009-154850; English Translation.

* cited by examiner

IMAGE FORMING APPARATUS HAVING PHOTOSENSITIVE MEMBER UNIT THAT MOVES BETWEEN AN OUTER POSITION AND AN OPERATIONAL POSITION

CROSS REFERENCE TO RELATED APPLICATION

This application claims priority from Japanese Patent Application No. 2009-154850, filed on Jun. 30, 2009, the entire subject matter of which is incorporated herein by reference.

FIELD

Aspects of the invention relate to image forming apparatus.

BACKGROUND

A known image forming apparatus includes a main body defining a sheet conveying path in which a recording sheet is conveyed, and a photosensitive member unit including a plurality of photosensitive members corresponding to respective colors. The photosensitive members are arranged in line or tandem with respect to the sheet conveying path. The image forming apparatus is of an electrophotographic type in which a color image is formed on a recording sheet by transferring toner images carried on the photosensitive drums onto a surface of the recording sheet conveyed in the sheet conveying path.

The photosensitive member unit is attachable to the main body by moving along a placement path between a position where the photosensitive member unit is removable outside the main body and an operational position where an image is ready to be formed in the main body. The photosensitive member unit is detachable from the main body by moving along the placement path in an opposite direction to an attachment direction.

The main body includes a force transmitting device that is configured to transmit a drive force from outside the main body in a width direction perpendicular to the sheet conveying path to the photosensitive member unit placed in the operational position. The photosensitive member unit includes a force receiving device, which is configured to engage the force transmitting device and receive a drive force from the force transmitting device when the photosensitive member unit is in the operational position.

The main body further includes: a contact surface that contacts, from below rearward, a positioning shaft protruding outward in the width direction from a front part of the photosensitive member unit placed in the operational position; a pressing arm that presses the positioning shaft that contacts the contact surface rearward; and a reference shaft that contacts, from below rearward, a cut portion recessed in a rear end of the photosensitive member unit in the operational position.

In the image forming apparatus, when the photosensitive member unit moves along the placement path and reaches the operational position, the positioning shaft contacts the contact surface, and the pressing arm presses the positioning shaft rearward. Thereby, the cut portion reliably contacts the reference shaft and the photosensitive member unit is positioned in a front-rear direction along the sheet conveying path.

SUMMARY

However, the photosensitive member unit may move to one side in the width direction during movement along the placement path due to widthwise clearance between the main body and the photosensitive member unit. As a result, when the photosensitive member unit reaches the operational position, it may be displaced in the width direction from an original position. When the force transmitting device of the main body engages the force receiving device of the photosensitive member unit in the operational position, a pressing force may act from the force transmitting device to the force receiving device in the width direction and the photosensitive member unit may be displaced in the width direction or in a direction opposite to a direction where the force transmitting device and the force receiving device face each other. In such cases, each of the photosensitive members arranged in line along the sheet conveying path may be displaced relatively to a recording medium on the sheet conveying path. More specifically, the photosensitive members may be parallelly displaced or inclined with respect to a centerline of the sheet conveying path, which may lead to deterioration of image quality.

Aspects of the invention may provide an image forming apparatus that is configured to reduce displacement of each photosensitive member placed in an operational position relative to a centerline of a sheet conveying path.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. Aspects of the invention are applied to an image forming apparatus, e.g. an electrophotographic image forming apparatus.

The general structure of an illustrative image forming apparatus, e.g. a printer 1 will be described with reference to FIG. 1. The printer 1 is a color laser printer that electrophotographically forms a color image on a recording sheet, e.g. a plain, glossy, or transparency sheet, with plural colors.

For ease of discussion, in the following description, directions are defined as viewed from a user who operates the printer 1 or defined when the printer is seen from the front side. The top or upper side, the bottom or lower side, the front or front side, the rear or rear side, the left or left side, and the right or right side of the image forming apparatus 1 are identified as indicated by the arrows in drawings. With regard to various individual objects of the printer 1, sides of the individual objects will be similarly identified based on the arranged/attached position of the object on/in the printer 1 shown in FIG. 1. The top and bottom direction may be referred to as a height direction, and the left and right direction may be referred to as a width direction.

Figure 1:
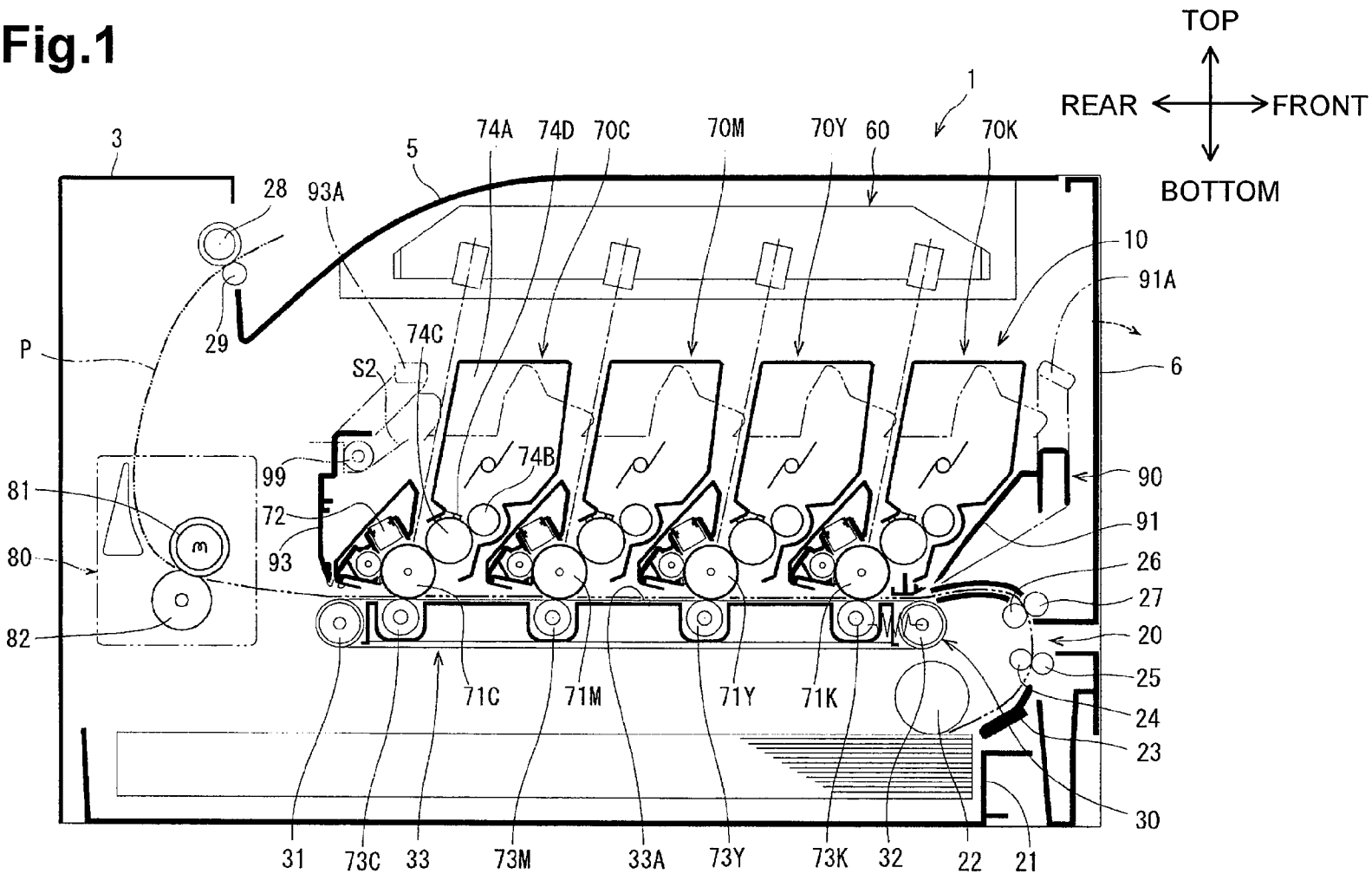
FIG. 1 is a sectional view schematically illustrating an image forming apparatus according to an illustrative embodiment.

As shown in FIG. 1, the printer 1 includes a main body 3 forming an external appearance of the printer 1 and having substantially a box shape. The main body 3 inside includes a right sidewall 3R shown in FIGS. 3 and 6 and a left sidewall 3L shown in FIGS. 5 and 6. In the main body 3, a sheet supply portion 20, a conveying unit 30, an image formation portion 10, and a fixing unit 80 are assembled to the left and right sidewalls 3L and 3R. The sheet supply portion 20 is disposed in a bottom portion of the main body 3. The conveying unit 30 is disposed above the sheet supply portion 20. The image formation portion 10 is disposed above the conveying unit 30 and located in substantially a center of the main body 3. The fixing unit 80 is disposed above the sheet supply unit 20 and at the rear of the image formation portion 10.

An upper surface of the main body 3 contains an output tray 5 to which ejection rollers 28 and 29 eject a recording sheet after image formation. In the main body 3, the recording sheet is conveyed from the sheet supply portion 20 toward the conveying unit 30, passing through the image formation portion 10 and the fixing unit 80, in substantially an S-shaped path (indicated by a thick double dotted line in FIG. 1). The S-shaped path is a sheet conveying path P. In the sheet conveying path P, a recording sheet is conveyed in a direction from the sheet supply portion 20 to the output tray 5. A direction perpendicular to the sheet conveying path P is a width direction, which is indicated as the left and right direction in the drawings. A front surface of the main body 3 contains a hinged front cover 6 which is pivotally attached at its lower end.

The image formation portion 10 includes a scanner unit 60 and a photosensitive member unit 90. A main body of the invention includes the main body 3, the left and right sidewalls 3L and 3R, the sheet supply portion 20, the scanner unit 60, the conveying unit 30, and the fixing unit 80, except for the photosensitive member unit 90.

The sheet supply portion 20 will be described.

The sheet supply portion 20 includes a sheet supply tray 21, a sheet supply roller 22, and a separation pad 23. The sheet supply tray 21 is removably accommodated in the bottom portion of the main body 3 and configured to store a stack of recording sheets therein. The sheet supply roller 22 is disposed at a front upper end of the sheet supply tray 21 and configured to supply recording sheets stacked on the sheet supply tray 21 to the image formation portion 10. The separation pad 23 is configured to separate the recording sheets supplied by the sheet supply roller 22 one by one by application of a conveying force.

Conveying rollers 24 and 25 are disposed in a front-side U-shaped part of the sheet conveying path P, which is provided upstream thereof. The conveying rollers 24 and 25 are configured to apply a conveying force to the recording sheet conveyed to the image formation portion 10 in the U-shaped part. Registration rollers 26 and 27 are disposed at a downstream side from the conveying rollers 24 and 25. The registration rollers 26 and 27 are configured to contact a leading end of the recording sheet conveyed by the conveying rollers 24 and 25, correct skew of the recording sheet, and convey the recording sheet further to the image formation portion 10.

The conveying unit 30 is disposed between the sheet supply tray 21 and the image formation portion 10, and includes a conveying belt 33 and transfer rollers 73K, 73Y, 73M, and 73C.

The conveying belt 33 extends around a drive roller 31 located below the image formation portion 10 and toward the rear end thereof and a driven roller 32 located below the image formation portion 10 and toward the front end thereof. The conveying belt 33 is configured to move around the drive roller 31 and the driven roller 32 when the drive roller 31 rotates in sync with the registration rollers 26 and 27 of the sheet supply portion 20. The conveying belt 33 is disposed such that its outer surface extends substantially horizontally immediately below the image formation portion 10. The outer surface of the conveying belt 33 contacts a back side of the recording sheet and conveys the recording sheet along the sheet conveying path P. The outer surface of the conveying belt 33 is hereinafter referred to as a sheet conveying surface 33A.

The transfer rollers 73K, 73Y, 73M, and 73C are disposed in the conveying unit 30 such as to contact the conveying belt 33 on a backside of the sheet conveying surface 33A. As the conveying belt 33 is formed of conductive rubber, it is charged due to a negative electrical charge or voltage applied to each of the transfer rollers 73K, 73Y, 73M, and 73C. Thus, the sheet conveying surface 33A is electrostatically charged to attract the recording sheet, and conveys the recording sheet along the sheet conveying path P.

The image formation portion 10 includes the scanner unit 60 disposed in a top portion of the main body 3, and the photosensitive member unit 90 disposed below the scanner unit 60 and above the sheet conveying surface 33A.

The scanner unit 60 includes a laser light source, a polygon mirror, fθ lenses, and reflecting mirrors. A laser beam emitted from the laser light source, based on image data, may be deflected by the polygon mirror, pass through the fθ lenses, and be folded by the reflecting mirror to be directed to a surface of each of photosensitive drums 71K, 71Y, 71M, and 71C, on which an electrical latent image is formed.

As shown in FIGS. 1, 2, 4 and 6, the photosensitive member unit 90 includes a front wall 91, a right frame 92R, a left frame 92L, and a rear wall 93, which are assembled together. The photosensitive member unit 90 may be referred to as a drawer unit. The left frame 92L and the right frame 92R support four photosensitive drums 71K, 71Y, 71M, and 71C therebetween such that the photosensitive drums 71K, 71Y, 71M, and 71C are rotatable in contact with the sheet conveying surface 33A of the conveying belt 33. Four process cartridges 70K, 70Y, 70M, and 70C are removably attached to the left frame 92L and the right frame 92R above the corresponding photosensitive drums 71K, 71Y, 71M, and 71C. Known chargers 72 are disposed facing the corresponding photosensitive drums 71K, 71Y, 71M, and 71C.

The photosensitive drums 71K, 71Y, 71M, and 71C and the process cartridges 70K, 70Y, 70M, and 70C are provided for four colors of black, yellow, magenta, and cyan. As shown in FIG. 1, the photosensitive drums 71K, 71Y, 71M, and 71C and the process cartridges 70K, 70Y, 70M, and 70C are arranged in line in the order from an upstream side of the sheet conveying path P toward a downstream side thereof, such as to face the sheet conveying surface 33A. A printer having such an arrangement is called a tandem-type printer.

The process cartridges 70K, 70Y, 70M, and 70C are structurally identical but contain different colors of toner. Thus, in the following description, the structure of the process cartridges will be made based on the process cartridge 70C as an example.

The process cartridge 70C includes a toner chamber 74A in which toner is stored, a supply roller 74B, and a developing roller 74C. Toner in the toner chamber 74A is supplied to the developing roller 74C along with the rotation of the supply roller 74B. The toner supplied to the developing roller 74C is carried on a surface of the developing roller 74C, regulated to a uniform thickness by a layer thickness regulating blade 74D, and then supplied to the surface of the photosensitive drum 71C that is exposed to light by the scanner unit 60.

The fixing unit 80 is disposed on a downstream side from the photosensitive member unit 90 in the sheet conveying path P. The fixing unit 80 includes a heat roller 81 and a pressure roller 82. The heat roller 81 is disposed such as to face a surface of a recording sheet on which an image is to be formed. The heat roller 81 is configured to rotate in sync with the conveying belt 33 and apply a conveying force to the recording sheet, while heating toner is transferred onto the recording sheet. The pressure roller 82 is disposed facing the heat roller 81 such that the heat roller 81 and the pressure roller 82 sandwich the recording sheet. The pressure roller 82 is configured to rotate while pressing the recording sheet toward the heat roller 81. Thus, the fixing unit 80 is configured to melt the toner transferred onto the recording sheet by heat and fix it to the recording sheet, while conveying the recording sheet downstream along the sheet conveying path P. The sheet conveying path P is curved upward in substantially a U shape, on a downstream side from the fixing unit 80. The output tray 5 and ejection rollers 28 and 29 are located at the most downstream side of the sheet conveying path P.

In the printer 1, an image is formed on a recording sheet as follows. When the image formation starts, the sheet supply portion 20 and the conveying unit 30 operate to convey a recording sheet to the image formation portion 10, and the scanner unit 60, the photosensitive drums 71K, 71Y, 71M and 71C, and the process cartridge 70K, 70Y, 70M and 70C operate. Then, the surfaces of the rotating photosensitive drums 71K, 71Y, 71M and 71C are uniformly and positively charged by the respective chargers 72, and exposed to laser beams emitted from the scanner unit 60, so that latent images corresponding to image data are formed on the surfaces of the photosensitive drums 71K, 71Y, 71M and 71C.

Along with the rotation of the developing rollers 74C, positively charged toner carried on the developing rollers 74C contact the corresponding photosensitive drums 71K, 71Y, 71M and 71C, and is supplied to the latent images formed on the surfaces of the photosensitive drums 71K, 71Y, 71M and 71C. As a result, the latent images become visible and a reversal takes place. Thus, toner images are formed on the surfaces of the photosensitive drums 71K, 71Y, 71M and 71C.

The toner images carried on the surfaces of the photosensitive drums 71K, 71Y, 71M and 71C are transferred onto the recording sheet by a voltage applied to the transfer rollers 73K, 73Y, 73M and 73C. When the recording sheet is conveyed to the fixing unit 80, it is heated by the heat roller 81 and the pressure roller 82, so that the toner transferred onto the recording sheet as the toner images is fixed on the recording sheet. Finally, the recording sheet having the image is ejected to the output tray 5, and image formation is finished.

The photosensitive member unit 90 is configured to be attached to and removed from the left and right sidewalls 3L and 3R for maintenance and replacement of consumable parts. Specifically, the photosensitive member unit 90 is configured to move between an operational position shown in FIG. 1 in which an image is ready to be formed in the main body 3 and a removable position shown in FIG. 7 in which the photosensitive member unit 90 is partially disposed outside of the main body 3 and the process cartridges 70K-70C are ready to be removed.

Figure 2:
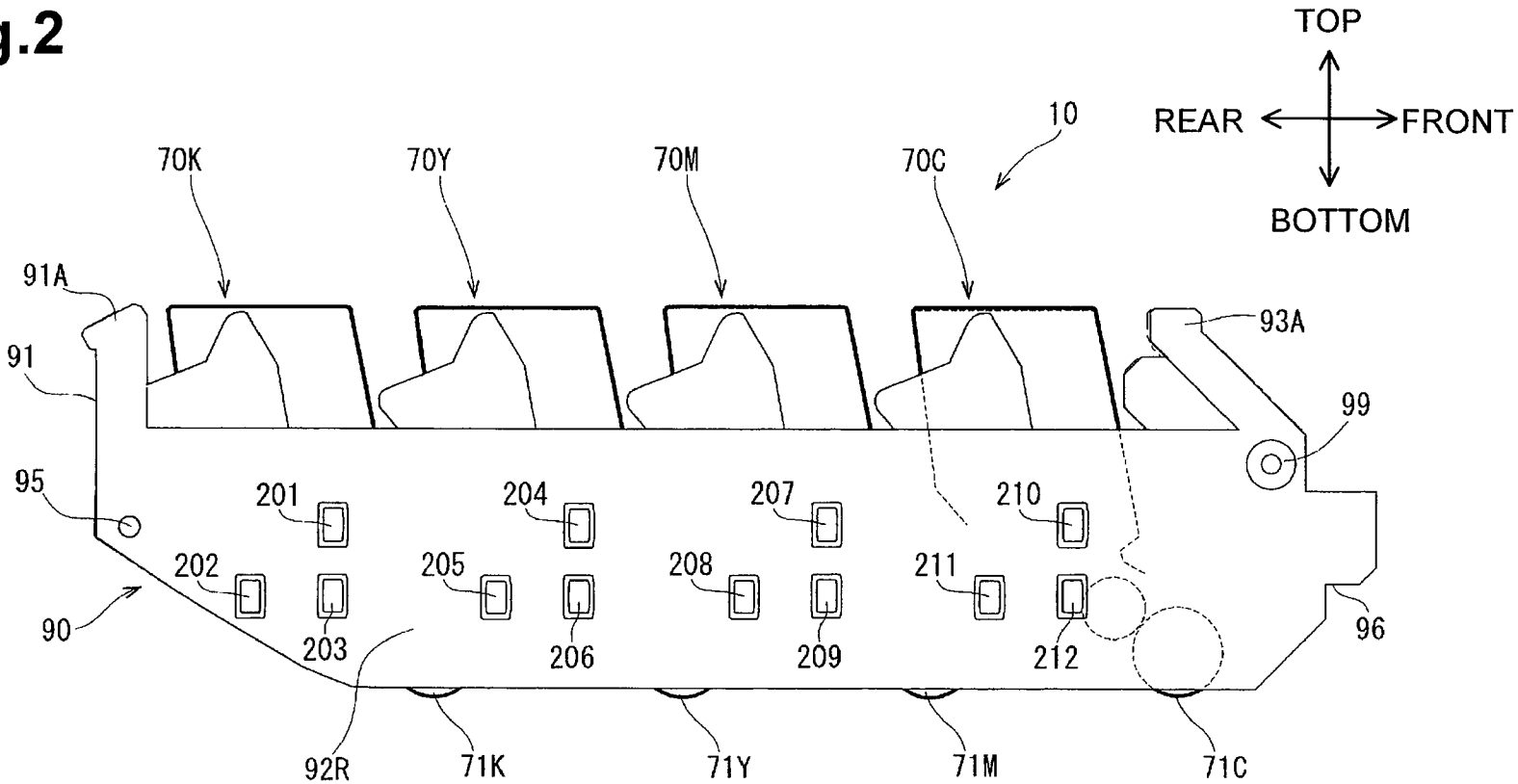
FIG. 2 is a right side view of a photosensitive member according to the image forming apparatus.
Figure 4:
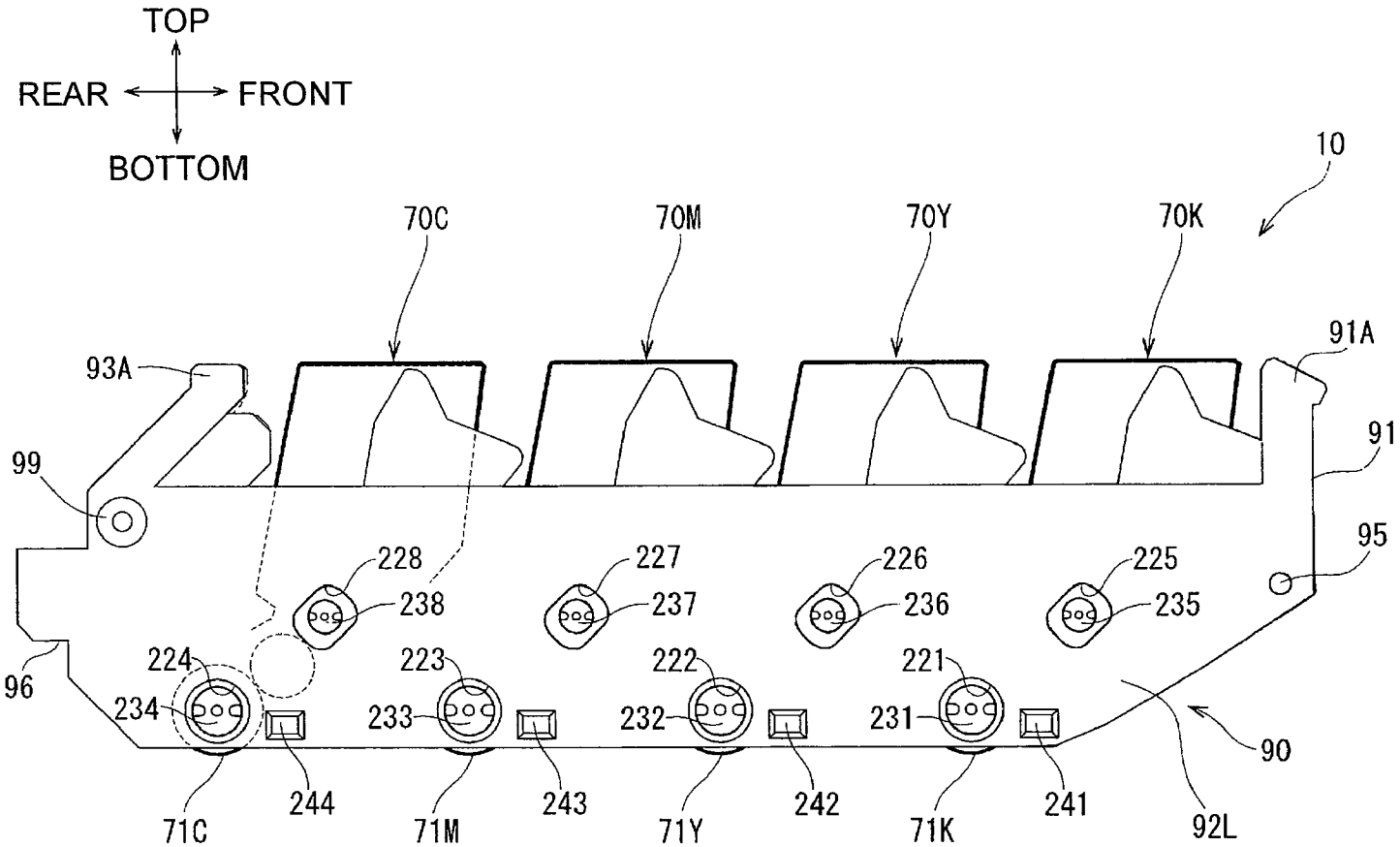
FIG. 4 is a left side view of the photosensitive member unit according to the image forming apparatus.

As shown in FIGS. 2 and 4, the photosensitive member unit 90 is provided with a front handle 91A which protrudes upward from the front wall 91 and a rear handle 93A which protrudes upward from the rear wall 93.

The right frame 92R and the left frame 92L rotatably support a pair of cam followers 99 at their upper rear ends. The cam followers 99 protrude outside from the right frame 92R and the left frame 92L respectively and have a common axial center line in the width direction. Under the cam followers 99, cut portions 96 are provided in the right frame 92R and the left frame 92L. Each of the cut portions 96 has a vertical edge and a horizontal edge. The right frame 92R and the left frame 92L further support a support shaft 95 at their front ends. The support shaft 95 extends in the width direction and has a circular cylindrical shape. Both ends of the support shaft 95 protrude outside from the right frame 92R and the left frame 92L respectively.

Figure 6:
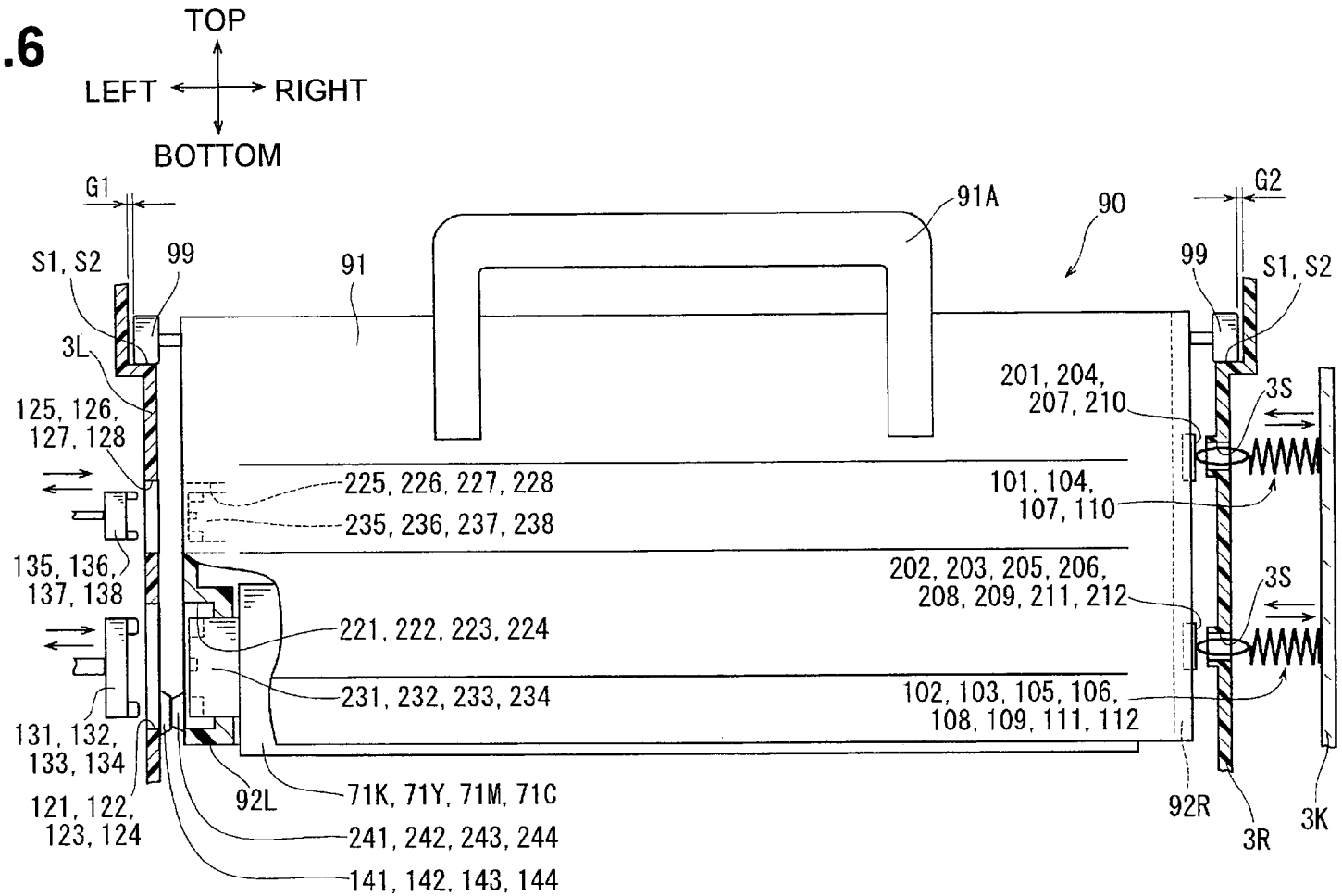
FIG. 6 is a sectional view schematically showing a relative positional relationship in a width direction of the image forming apparatus between the photosensitive member unit, the left and right sidewalls, a main body-side electrode, a unit-side electrode, a force transmitting device, a force receiving device, a positioning protrusion, and a reference surface.

As shown in FIG. 2, the right frame 92R of the photosensitive member unit 90 includes unit-side electrodes 201-212 on an outer surface in the width direction. The unit-side electrodes 201-212 are arranged in two rows and spaced a predetermined distance in the front-rear direction. As shown in FIG. 6, each unit-side electrode 201-212 is located substantially flush with the outer surface of the right frame 92R so as not to protrude therefrom so much for compact size of the photosensitive member unit 90. Inside the photosensitive member unit 90, the unit-side electrodes 201-212 are electrically connected to the developing rollers 74C, the photosensitive drums 71K-71C and the chargers 72.

As shown in FIG. 4, the left frame 92L of the photosensitive member unit 90 includes openings 221-228 provided in two rows and spaced a predetermined distance in the front-rear direction. Bottom openings 221-224 hold force receiving devices 231-234, which are directly coupled to left ends of the photosensitive drums 71K-71C. Top openings 225-228 hold force receiving devices 235-238, which are coupled to the developing rollers 74C of the process cartridges 70K-70C. The force receiving devices 231-238 are known couplings used for drive force transmission. As shown in FIG. 6, the force receiving devices 231-238 are located so as not to protrude from an outer surface of the left frame 92L for compact size of the photosensitive member unit 90.

As shown in FIG. 4, the left frame 92L includes positioning protrusions 241-244 which protrude from the left frame 92L and are spaced in the front-rear direction and disposed adjacent to a corresponding one of the bottom force receiving devices 231-234. Each of the positioning protrusions 241-244 includes an opposing surface, which contacts a corresponding one of the reference surfaces 141-144, and inclined surfaces inclined from the opposing surface. As shown in FIG. 6, each of the positioning protrusions 241-244 is shaped in a trapezoid which narrows outward in the width direction. The frontmost and rearmost positioning protrusions 241 and 244 protrude outward slightly more than the central positioning protrusions 242 and 243. That is, the frontmost and rearmost positioning protrusions 241 and 244 are designed to preferentially contact reference surfaces 141-144 shown in FIG. 5, while the central positioning protrusions 242 and 243 are designed to secondarily contact the reference surfaces 141-144.

Figure 3:
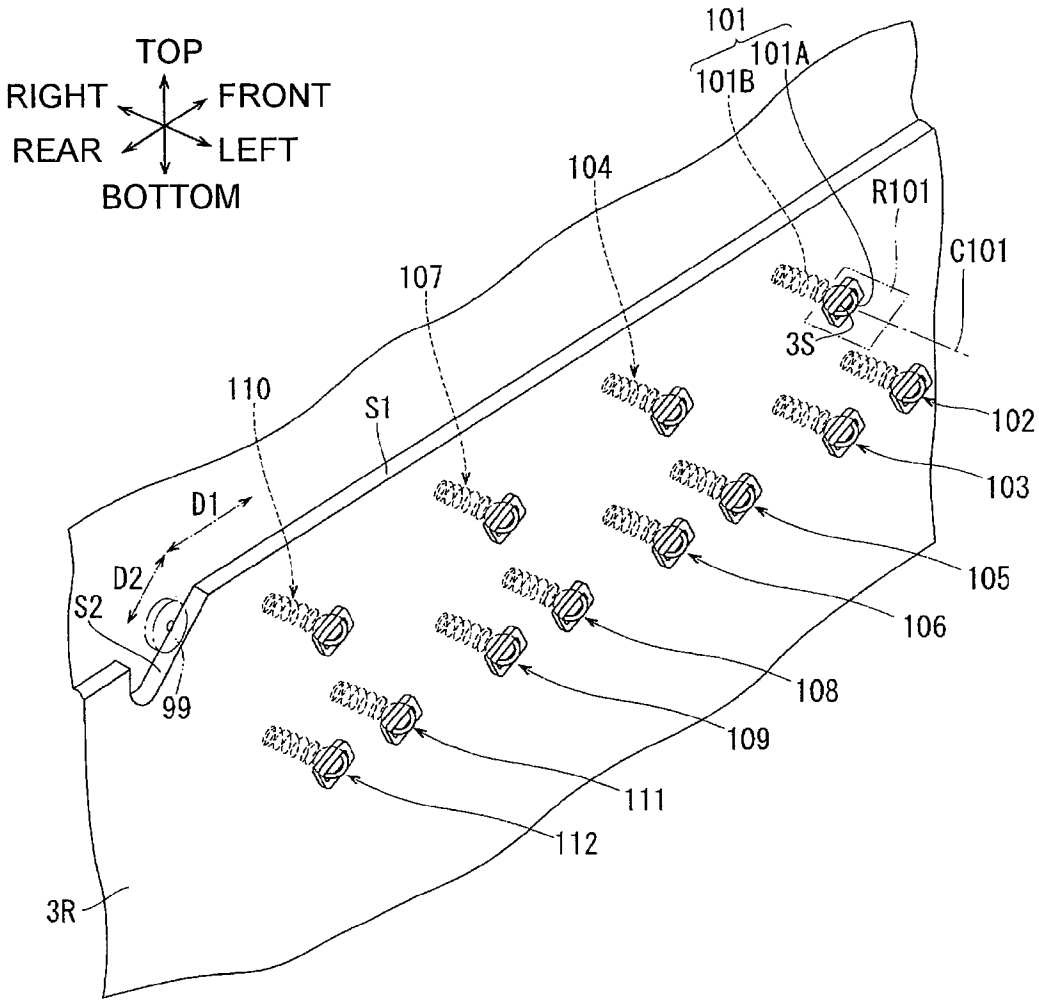
FIG. 3 is a perspective view showing a right sidewall according to the image forming apparatus.
Figure 5:
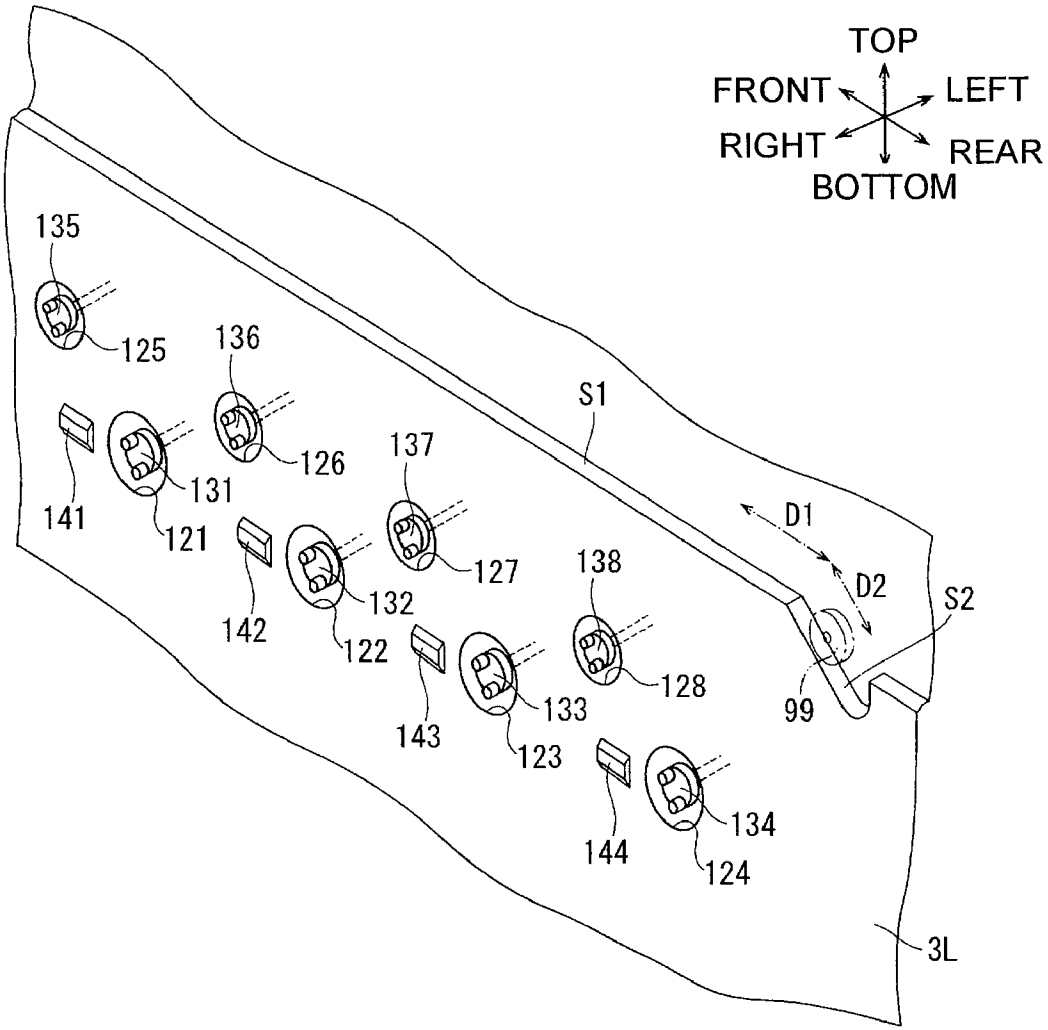
FIG. 5 is a perspective view of a left sidewall according to the image forming apparatus.

As shown in FIGS. 3 and 5, each of the right sidewall 3R and the left sidewall 3L, which are disposed to sandwich the photosensitive member unit 90 from both sides in the width direction, is formed with a first guide surface S1 and a second guide surface S2. The first and second guide surfaces S1 and S2 are configured to guide the cam follower 99.

The first guide surface S1 is a flat surface which is horizontal in the front-rear direction and the width direction and is thin and long in the front-rear direction. The second guide surface S2 is a flat surface which is horizontal in the width direction and inclined downward toward the rear. A rear end of the first guide surface S1 is connected to a front end of the second guide surface S2, and the first guide surface S1 and the second guide surface S2 provide a bent guide surface. As shown in FIG. 6, there are a widthwise gap G1 between the left sidewall 3L and an end surface of the left cam follower 99, and a widthwise gap G2 between the right sidewall 3R and an end surface of the right cam follower 99. The gaps G1 and G2 are provided for smooth movement of the cam followers 99.

As shown in FIGS. 3 and 6, the right sidewall 3R includes main body-side electrodes 101-112, which are located to face the unit-side electrodes 201-212 when the photosensitive member unit 90 is in the operational position. The main body-side electrodes 101-112 are structurally identical and each connected to a power source, a control circuit, and other elements, which are not shown. Thus, in the following, the structure of the main body-side electrodes 101-112 will be described based on the main body-side electrode 101 as an example.

As shown in FIG. 3, the main body-side electrode 101 includes a contact portion 101A and an elastic portion 101B which is made of a wire by bending. The elastic portion 101B is bent into a coil spring having a center line C101 parallel with the width direction. As shown in FIG. 6, the elastic portion 101B is disposed under compression between the right sidewall 3R and a circuit board 3K having electronics. The contact portion 101A is connected from the elastic portion 101B. The contact portion 101A is bent into a ring portion having a greater diameter than the coil spring of the elastic portion 101B, and the ring portion is bent perpendicular to the elastic portion 101B such that it is located along the center line C101. The contact portion 101A partially protrudes from a rectangular slit 3S, which is provided in the right sidewall 3R, toward inside in the width direction or toward the right frame 92R of the photosensitive member unit 90 located in the operational position.

The slit 3S has a size greater than an outer diameter of the ring portion of the contact portion 101A, wider than the wire thickness, and smaller than a diameter of the coil spring of the elastic portion 101B. Thus, the contact portion 101A is configured to move in the width direction under the urge of the elastic portion 101B or against the action of the elastic portion 101B.

As shown in FIG. 3, a flat surface R101 including the ring portion of the contact portion 101A is defined so as to cross the first and second guide surfaces S1 and S2 at a shallow angle. This angle minimizes contact resistance between the contact portion 101A and the right frame 92R during movement of the photosensitive member unit 90, to reduce problems such as torsion or bending of the contact portion 101A.

As shown in FIGS. 5 and 6, the left sidewall 3L includes openings 121-128 which are provided at positions corresponding to the force receiving devices 231-238 when the photosensitive member unit 90 is located in the operational position. The openings 121-128 receive force transmitting devices 131-138 for transmitting a drive force to the force receiving devices 231-238. The force transmitting devices 131-138 are known couplings used for drive force transmission, and are coupled to a motor, not shown. As shown in FIG. 6, the force transmitting devices 131-138 are configured to protrude inward in the width direction or toward the left frame 92L and engage the corresponding force receiving devices 231-238 in response to a link mechanism, not shown, that operates in accordance with the opening and closing movement of the front cover 6 when the photosensitive member unit 90 is located in the operational position.

As shown in FIG. 5, the left sidewall 3L includes reference protrusions protruding from the left sidewall 3L and having reference surfaces 141-144, which are provided at positions facing the opposing surfaces of the positioning protrusions 241-244 when the photosensitive member unit 90 is in the operational position. As shown in FIG. 6, each of the reference protrusions is shaped in a trapezoid which narrows inward in the width direction or toward the left frame 92L of the photosensitive member unit 90 in the operational position. The reference surfaces 141-144 are flush with each other.

Figure 9:
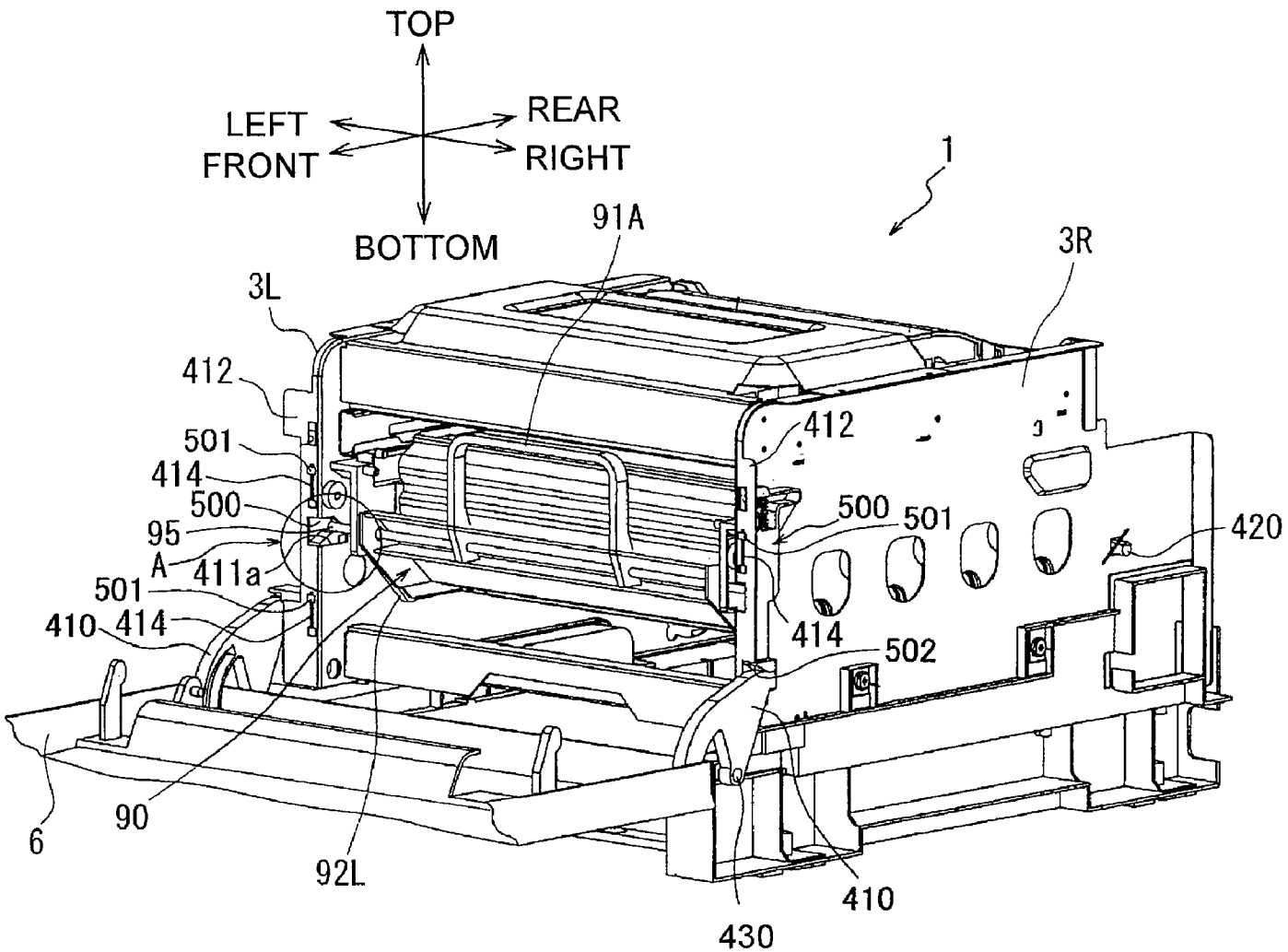
FIG. 9 is a perspective view of a configuration of the image forming apparatus with a front cover being open.
Figure 11:
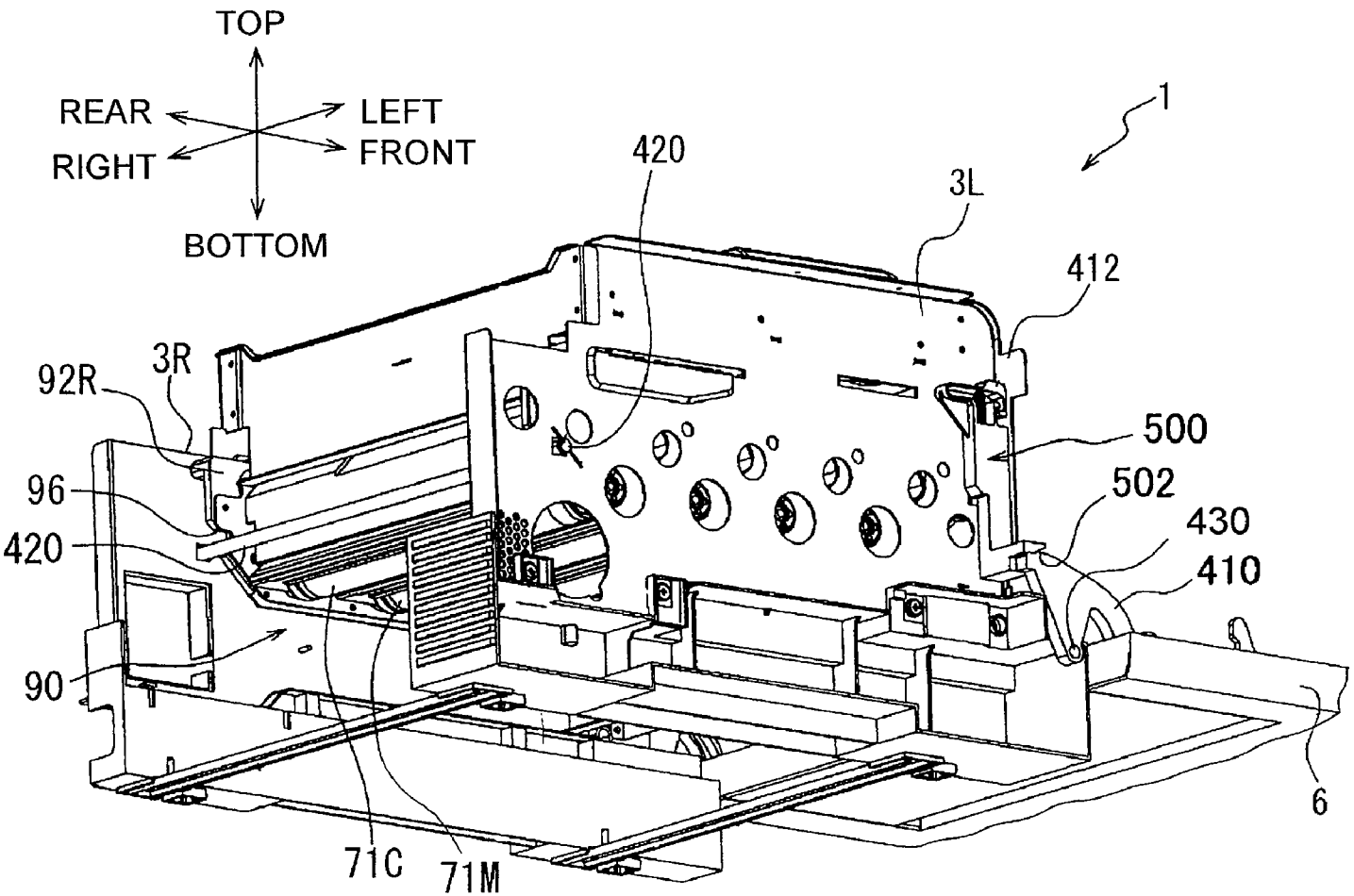
FIG. 11 is a perspective view of the configuration of the image forming apparatus with the front cover being open.

As shown in FIGS. 9 and 11, the front cover 6 is integrally formed with a pair of fan-shaped cam plates 410. The cam plates 410 are provided on both sides of the front cover 6 at its lower end and pivotally supported on pivot shafts 430. When the front cover 6 is open, the cam plates 410 extend from the front cover 6 toward the right and left sidewalls 3R and 3L respectively. The front cover 6 is supported to the left and right sidewalls 3L and 3R pivotally around pivot shaft 430 of each cam plate 410.

As shown in FIG. 9, the right and left sidewalls 3R and 3L are provided with flange portions 412 at their front ends, respectively. Each of the flange portions 412 is formed with two top and bottom through holes 414 which are thin and long in the top-bottom direction or vertical direction. Each of the flange portions 412 supports a locking member 500 which is slidable vertically. The locking member 500 includes engaging portions 501 which engage in the through holes 414 respectively. In each flanged portion 412, the locking member 500 is urged downward by engagement of the engaging portions 501 in the through holes 414. Although the locking member 500 also has a known lock function that holds the front cover in the closed position, the description of the known lock function is omitted in the embodiment.

Figure 10:
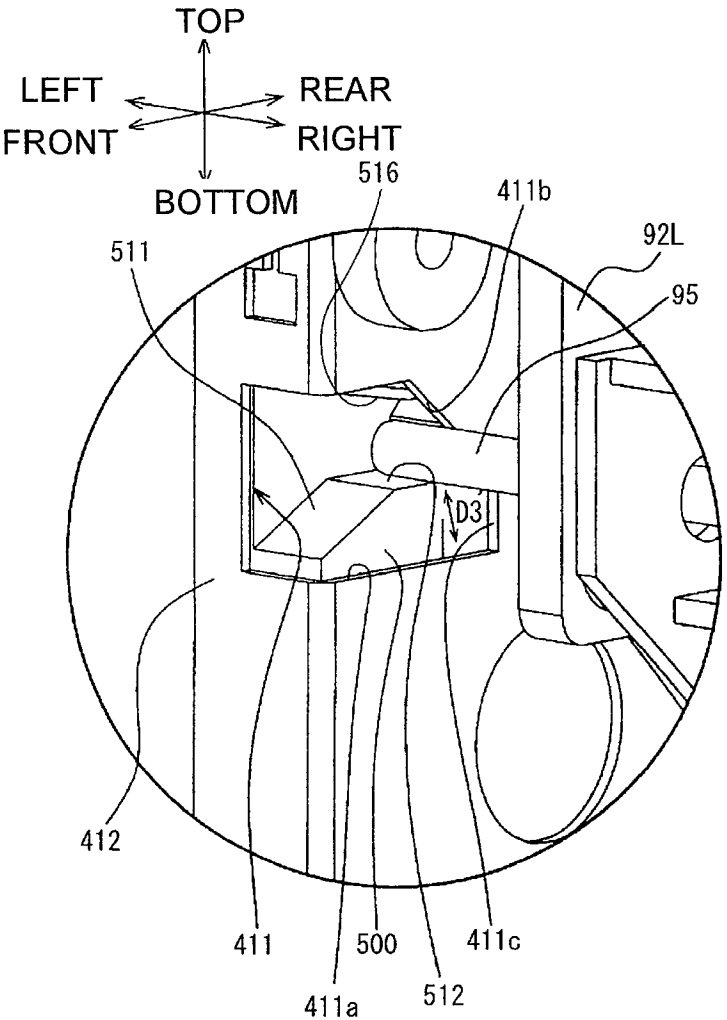
FIG. 10 is an enlarged perspective view of a part A shown in FIG. 9.
Figure 12:
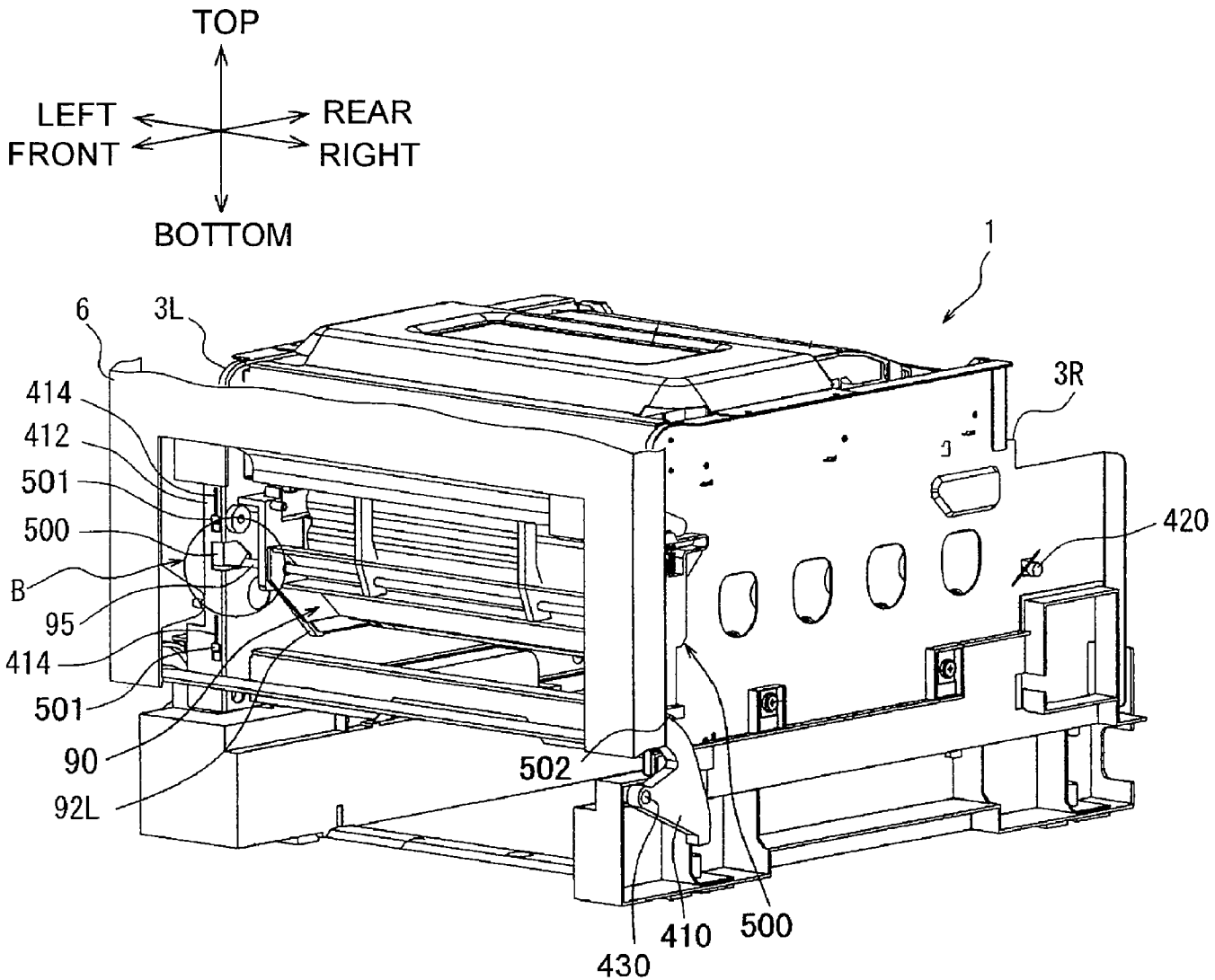
FIG. 12 is a perspective view of the configuration of the image forming apparatus with the front cover being closed, in which a movable cover is partially omitted.
Figure 13:
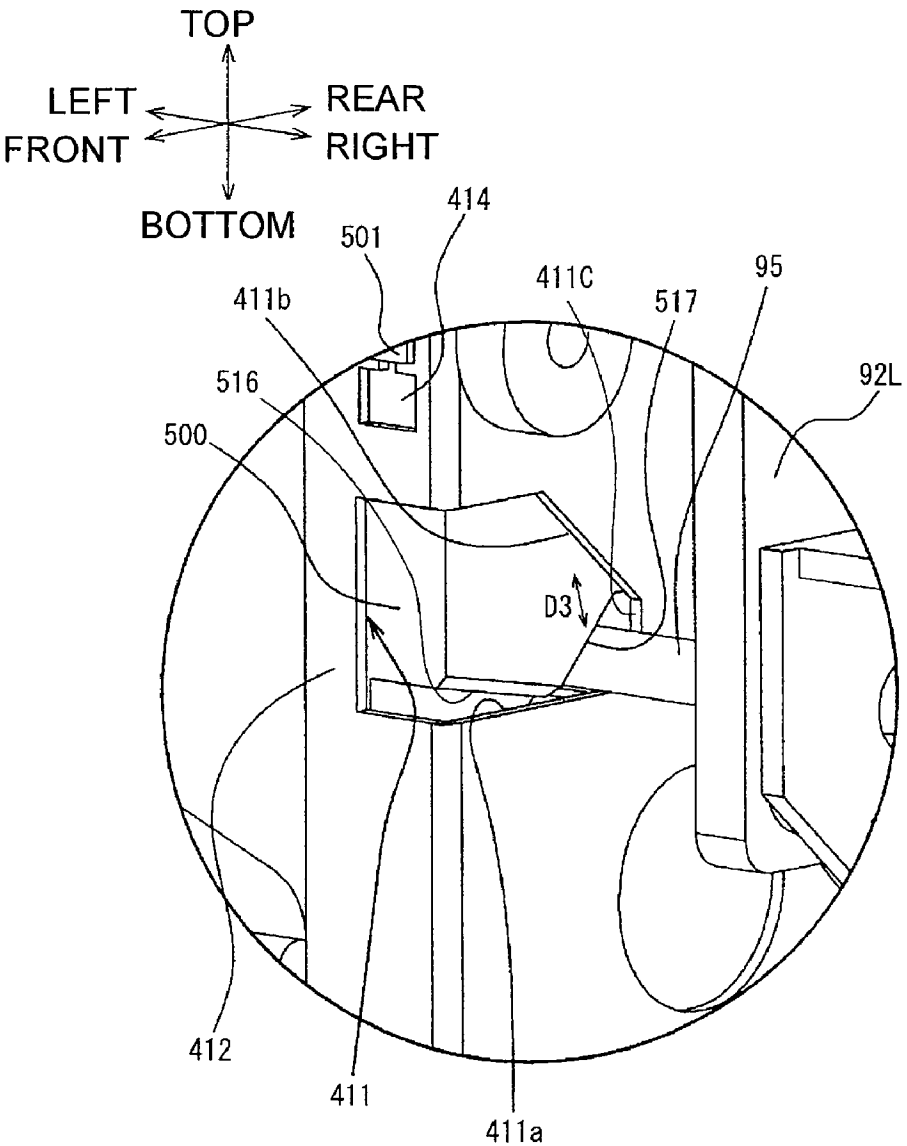
FIG. 13 is an enlarged perspective view of a part B shown in FIG. 12.

As shown in FIGS. 9 and 11, the locking member 500 is formed with a chamfered portion 502 at its lower end, such as to smoothly contact an outer circumferential surface of the cam plate 410 having a substantially arced shape. As described above, each cam plate 410 is pivotally supported on its corresponding pivot shaft 430. The outer circumferential surface of each cam plate 410 is shaped such that a distance between the outer surface and the pivot shaft 430 becomes shorter nearer the front cover 6. When each cam plate 410 pivots in contact with the chamfered portion 502, the locking member 500 moves vertically in response to the movement of the front cover 6. As shown in FIGS. 9-11, when the front cover 6 is open, the locking member 500 moves upward. As shown in FIGS. 12 and 13, when the front cover 6 is closed, the locking member 500 moves downward.

As shown in FIGS. 9, 10 and 13, each of the right frame 3R and the left frame 3L is formed at the front end with a support hole 411. The support shaft 95 is supported at the support holes 411. Each support hole 411 is defined by a bottom wall surface 411*a* that extends horizontally in the front-rear direction, an upper wall surface 411*b* that is spaced upward from the bottom wall surface 411*a* and inclined downward toward the rear, and a vertical wall surface 411*c* that connects a rear end of the bottom wall surface 411*a* and a rear end of the upper wall surface 411*b*.

When the front cover 6 is open and the locking member 500 is at its upper position, a bottom inclined surface 511 and a flat surface 512 of the locking member 500 are exposed from the support hole 411 of each of the right frame 3R and the left frame 3L, as shown in FIG. 10. The bottom inclined surface 511 is inclined from the front upward toward the rear in a middle of the locking member 500 in a vertical direction. The flat surface 512 adjoins to a rear end of the bottom inclined surface 511 and is disposed horizontally.

On the other hand, when the front cover 6 is closed and the locking member 500 is at its lower position, a first inclined surface 516 and a second inclined surface 517 of the locking member 500 are exposed from the support hole 411 of each of the right frame 3R and the left frame 3L, as shown in FIG. 13. The first inclined surface 516 is spaced upward from the bottom inclined surface 511 and slightly inclined downward toward the rear. The second inclined surface 517 is inclined approximately 45 degrees from a rear end of the first inclined surface 516 upward toward the rear. In other words, when the locking member 500 moves downward, the bottom inclined surface 511 and the flat surface 512 moves below the bottom wall surface 411*a* of the support hole 411, and the first inclined surface 516 and the second inclined surface 517 move downward until they are positioned within the support hole 411.

An operation to attach the photosensitive member unit 90 to the left and right sidewalls 3L and 3R will be described.

Figure 7:
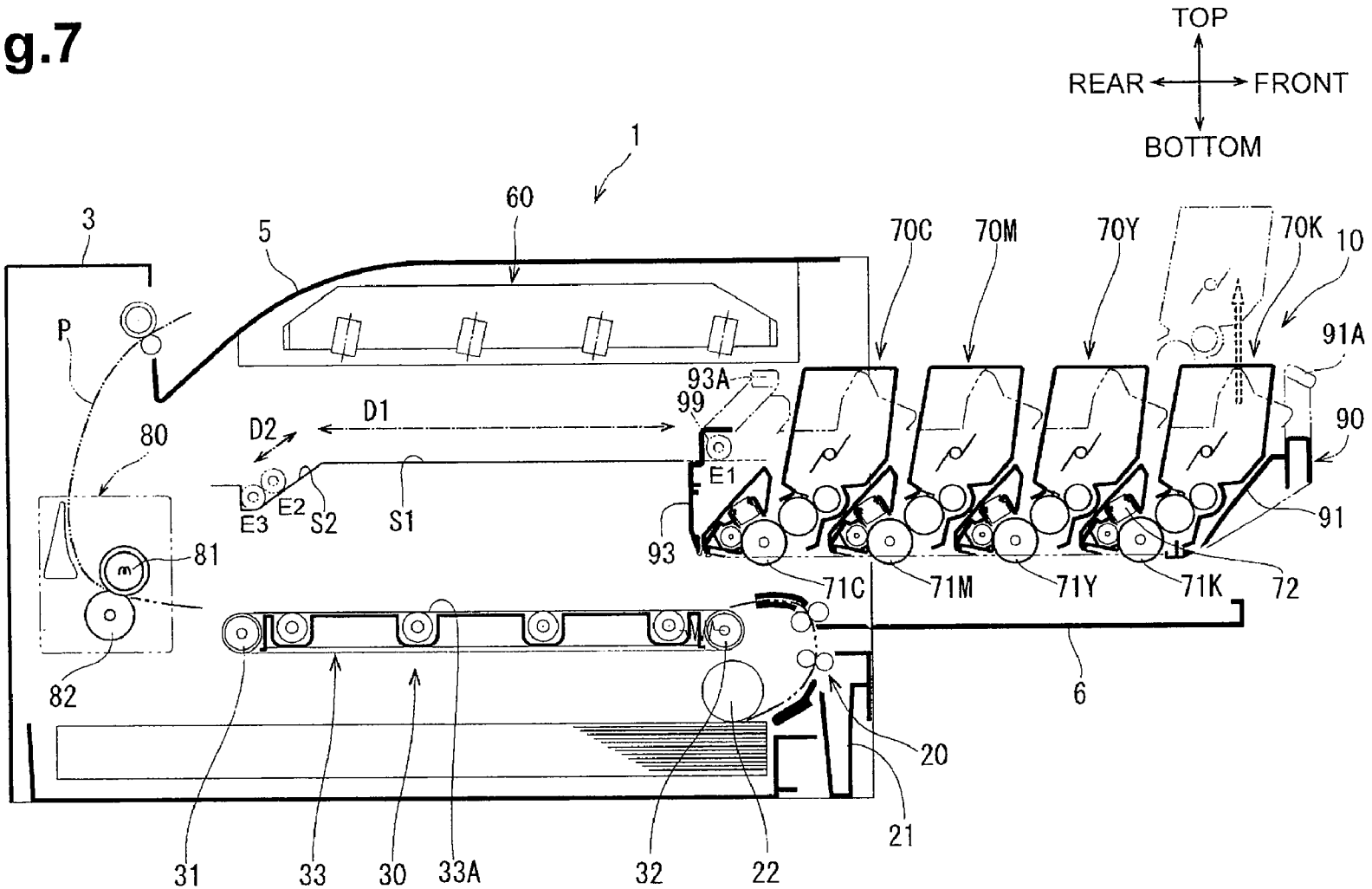
FIG. 7 is a sectional view schematically showing how the photosensitive member unit is attached or removed.

When the user inserts the photosensitive member unit 90 between the left and right sidewalls 3L and 3R of the main body 3, the user holds the handles 91A and 93A and places the photosensitive member unit 90 on the open front cover 6 as shown in FIG. 7. That is, with the front cover 6 open, the user places each cam follower 99 located on the rear side of the photosensitive member unit 90 in a first position E1 on the first guide surface S1. While holding the front handle 91A, the user inserts the photosensitive member unit 90 into the main body 3. The cam follower 99 rolls horizontally along the first guide surface S1, so that the photosensitive member unit 90 is inserted horizontally along a first path D1 parallel to the first guide surface S1. At this time, to maintain the gap G1 between the left sidewall 3L and the end surface of the left cam follower 99 and the gap G2 between the right sidewall 3R and the end surface of the right cam follower 99, the first path D1 has a width slightly greater than that of the photosensitive member unit 90 including the cam followers 99, allowing the photosensitive member unit 90 to be easily inserted along the first path D1. However, due to the gaps G1 and G2, the photosensitive member unit 90 may sway during insertion in the first path D1. In addition, if the photosensitive member unit 90 is inserted in the first path D1 with being shifted to one side, e.g. the right side, the photosensitive member unit 90 may be located at a position shifted to the right side from its correct position (corresponding to the operational position). In the printer 1 of the embodiment, however, the main body-side electrodes 101-112 of the right sidewall 3R contact the photosensitive member unit 90 moving along the first path D1, in order starting from the main body-side electrodes 101 and 102, which are located at the front part of the right sidewall 3R. Each of the main body-side electrodes 101-112 applies a leftward pressing force to the photosensitive member unit 90 such that the left frame 92L of the photosensitive member unit 90 approaches the left sidewall 3L. With the pressing force of the main body-side electrodes 101-112, the chance of the photosensitive member unit 90 from swaying or being located at the position shifted to the right side from the correct position can be reduced.

Figure 8:
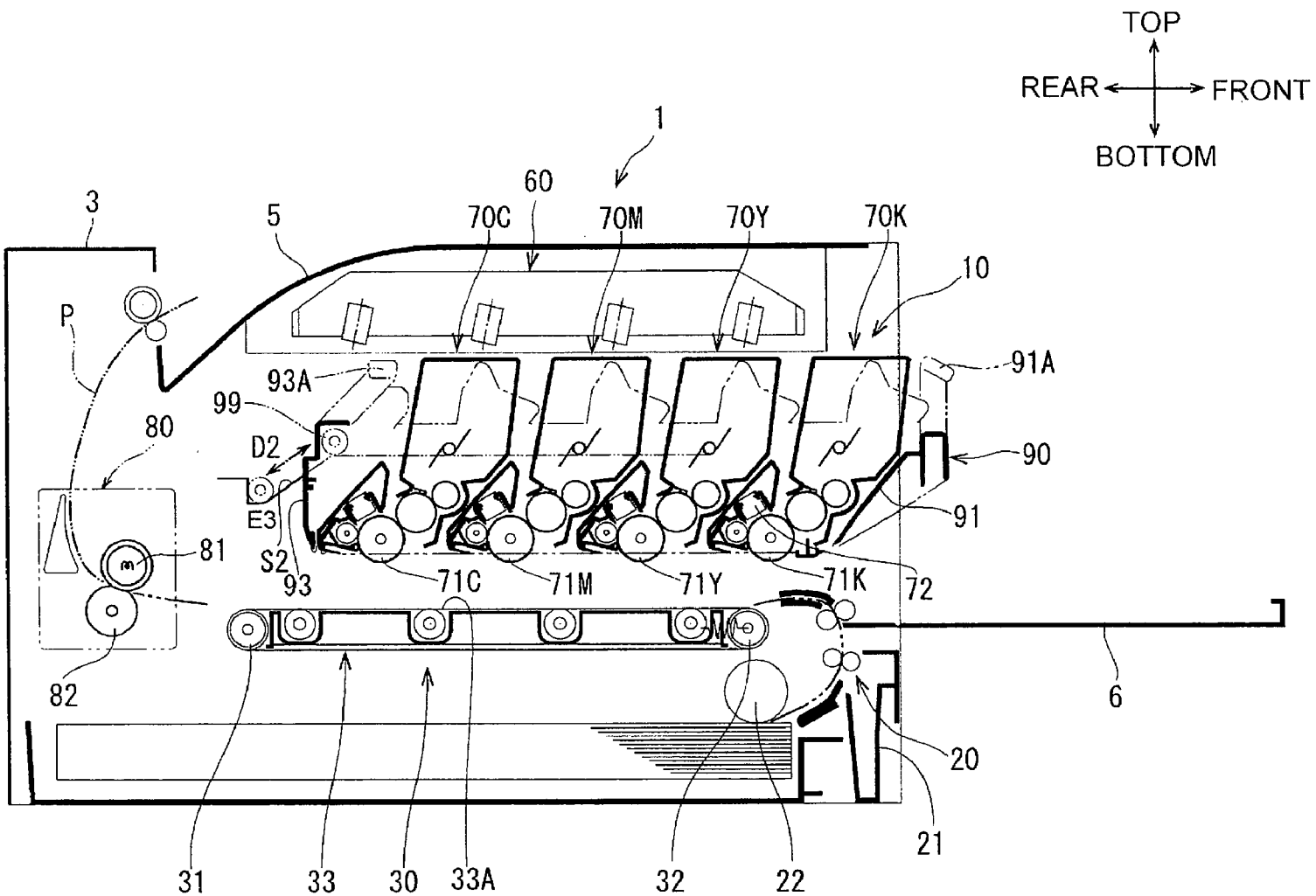
FIG. 8 is a sectional view schematically showing how the photosensitive member unit is attached or removed.

As shown in FIG. 8, when the photosensitive member unit 90 is inserted further rearward into the main body 3, each cam follower 99 moves from the first guide surface S1 to the second guide surface S2, and then rolls obliquely downward along the second guide surface S2. The photosensitive member unit 90 is inserted obliquely downward in a second path D2 parallel to the second guide surface S2, and is positioned near the sheet conveying surface 33A. At this time as well, each of the main body-side electrodes 101-112 applies to a pressing force to the photosensitive member unit 90 such that the left frame 92L of the photosensitive member unit 90 approaches the left sidewall 3L.

As shown in FIGS. 9 and 10, when the photosensitive member unit 90 is inserted further rearward into the main body 3 along the second path D2, the support shaft 95, which is disposed at the front of the photosensitive member unit 90, is inserted into the support hole 411 on each side, and abuts against and stops at the upper wall surface 411*b* and the flat surface 512. At this time, the cam follower 99 is located in and stops at a second position E2. This position is an end of the second path D2 or a position immediately before the operational position. In this position, the photosensitive member unit 90 is positioned slightly above the sheet conveying surface 33A. At this time, as shown in FIG. 11, the cut portions 96 of the left and right sidewalls 3L and 3R are located at positions slightly spaced apart, frontward and upward, from a reference shaft 420 extending between the left and right sidewalls 3L and 3R at their rear sides.

While the cam follower 99 moves from the first position E1 to the second position E2, each of the main body-side electrodes 101-112 sequentially urges the photosensitive member unit 90 toward a corresponding one of the reference surfaces 141-144. Thereby, when the cam follower 99 is located in the second position E2, the positioning protrusions 241-244 are located in a position slightly higher than that shown in FIG. 6, and shifted slightly upward with respect to the reference surfaces 141-144. In other words, when the cam follower 99 is located in the second position E2, the positioning protrusions 241-244 do not yet contact the reference surfaces 141-144.

When the front cover 6 is closed, the cam follower 99 moves from the second position E2 to a third position E3 (FIG. 7). When the cam follower 99 moves to the third position, each of the reference surfaces 141-144 guides a corresponding one of the positioning protrusions 241-244 at their inclined surfaces. When the cam follower 99 is located in the third position E3, the reference surfaces 141 and 144, which are disposed at the front side and the rear side of the left sidewall 3L, preferentially contact the positioning protrusions 241 and 244 as shown in FIG. 6, so that the photosensitive member unit 90 is positioned in the predetermined position in the width direction. The reference surfaces 142 and 143 secondarily contact the corresponding positioning protrusions 242 and 243, so that the photosensitive member unit 90 is reliably positioned in the predetermined position in the width direction.

In addition, when the front cover 6 is closed and the cam follower 99 moves from the second position E2 to a third position E3, the locking member 500 moves downward as shown in FIGS. 12 and 13. The cam follower 99 stops at the third position E3, the flat surface 512, which has contacted the support shaft 95 from below, moves below the bottom wall surface 411*a*. In addition, the second inclined surface 517 presses the support shaft 95 downward, and the support shaft 95 moves down until it is positioned within the support hole 411. The support shaft 95 moves downward to the rear or along a third path D3 shown in FIG. 10 while contacting the upper wall surface 411*b*, such that the support shaft 95 is held between the bottom wall surface 411*a*, the vertical wall surface 411*c*, and the second inclined surface 517. Although not shown, the cut portions 96 also move downward to the rear and stop against the reference shaft 420 shown in FIG. 11. Thus, the photosensitive member unit 90 can be positioned in the predetermined position in the front-rear direction and the top-bottom direction. In this manner, the photosensitive member unit 90 reaches the operational position.

When the cam follower 99 stops at the third position E3 and the photosensitive member unit 90 reaches the operational position along the path D3, the positioning protrusions 241-244 contact the corresponding reference surfaces 141-144 as shown in FIG. 6. Each of the main body-side electrodes 101-112 applies a force to the photosensitive member unit 90 such that the left frame 92L of the photosensitive member unit 90 approaches the left sidewall 3L.

In addition, when the photosensitive member unit 90 reaches the operational position, the contact portion 101A of each of the main body-side electrodes 101-112 contacts and electrically connects with the corresponding one of the unit-side electrodes 201-212. Thus, electricity can be sent from the power supply provided on the right sidewall 3R and the electronics on the circuit board 3K to parts of the photosensitive member unit 90 including the photosensitive drums 71K-71C.

After the photosensitive member unit 90 reaches the operational position, the link mechanism (not shown) operates in accordance with the movement of the front cover 6, and the force transmitting devices 131-138 move inward in the width direction or toward the left sidewall 92L of the photosensitive member unit 90 for engagement with the corresponding force receiving devices 231-238. As the photosensitive member unit 90 is pressed toward the left in the width direction, the force transmitting devices 131-138 accurately engage the corresponding force receiving devices 231-238. Thus, the force transmitting devices 131-138 can transmit a drive force from the drive motor provided on the left sidewall 3L to the photosensitive member unit 90. When the force transmitting devices 131-138 move inward in the width direction or rightward, the photosensitive member unit 90 may receive a force tending to displace the photosensitive member unit 90 toward the right sidewall 3R via the force receiving devices 231-238. However, the force of the main body-side electrodes 101-112 directed toward the left sidewall 3L reduces the force tending to displace the photosensitive member unit 90 toward the right sidewall 3R.

In this manner, the photosensitive member unit 90 moves along the placement paths D1-D3 and reaches the operational position. The photosensitive member unit 90 is positioned in the predetermined position in the width direction by the main body-side electrodes 101-112 reliably. In this embodiment, the photosensitive member unit 90 is positioned leftward in the width direction in the placement paths D1-D3. As a result, the risk of the photosensitive drums 71K-71C undesirably inclining with respect to a centerline of the sheet conveying path P or a centerline of the sheet conveying surface 33A in the front-rear direction can be reduced. In addition, potential displacement of the photosensitive drums 71K-71C with respect to the centerline of the sheet conveying path can be reduced.

An operation to remove the photosensitive member unit 90 from the left and right sidewalls 3L and 3R will be described.

When the front cover 6 is open, the link mechanism, not shown, operates in accordance with the movement of the front cover 6, the force transmitting devices 131-138 move outward in the width direction or away from the left sidewall 92L, and disengage from the corresponding force receiving devices 231-238. Then, the locking member 500 moves upward, and the flat surface 512 also moves upward and raises the support shaft 95 as shown in FIG. 10. The support shaft 95 contacts the upper wall surface 411*b* and moves upward toward the front, in other words, moves along the third path D3 in an opposite direction to that of attachment. As shown in FIG. 11, the cut portions 96 also move toward the front and away from the reference shaft 420. Thus, the photosensitive member unit 90 is raised upward from the sheet conveying surface 33A.

As shown in FIG. 8, the user holds the handle 91A and pulls the photosensitive member unit 90 from the main body 3 toward the front. The cam followers 99 roll obliquely upward along the second guide surface S2. The photosensitive member unit 90 is pulled obliquely upward along the second path D2 in the opposite direction to that of the attachment and further moves away from the sheet conveying surface 33A.

When the photosensitive member unit 90 is pulled further to the front, the cam followers 99 moves from the second guide surface S2 to the first guide surface S1 and roll horizontally along the first guide surface S1 as shown in FIG. 7. In this manner, the photosensitive member unit 90 is pulled horizontally along the first path D1 in the opposite direction to that of the attachment. The photosensitive member unit 90 is pulled to the removable position shown in FIG. 7, and the user holds the handles 91A and 93A to remove the photosensitive member unit 7 outside the main body 3.

According to the printer 1 of the embodiment, the main body-side electrodes 101-112 apply a force to the photosensitive member unit 90 moving along the placement paths D1-D3, at least immediately when the cam follower 99 is located in the second position E2 as shown in FIG. 7, so as to urge the positioning protrusions 241-244 of the photosensitive member unit 90 toward the corresponding reference surfaces 141-144 of the left sidewall 3L. Thus, at least the reference surfaces 141 and 144, which are disposed at the front side and the rear side of the left sidewall 3L, contact the corresponding positioning protrusions 241 and 244 from outside in the width direction, so that the photosensitive member unit 90 is reliably positioned in the predetermined position in the width direction.

After the photosensitive member unit 90 is reliably positioned in the predetermined position, even when a force acts from the force transmitting devices 131-138 to the force receiving devices 231-238 by engagement of the force transmitting devices 131-138 with the corresponding force receiving devices 231-238, the photosensitive member unit 90 is resistant to displacement in the width direction.

According to the printer 1 of the embodiment, when the photosensitive member unit 90 is located in the operational position shown in FIG. 1, positional relationship between each of the photosensitive drums 71K-71C and a sheet to be fed in the sheet conveying path P can be maintained. As a result, reduction in quality of image formation can be minimized.

According to the printer 1 of the embodiment, each of the main body-side electrodes 101-112 serves as a pressing device. The printer 1 can reduce the number of parts compared with a case to provide a part designed exclusively for a pressing device.

In the embodiment, the main body-side electrodes 101-112 are configured to serve as pressing devices, and can apply a force to the photosensitive member unit 90 while dispersing the force from different positions, and press the photosensitive member unit 90 evenly in the width direction. Thus, when the photosensitive member unit 90 reaches the operational position shown in FIG. 1, the positioning protrusions 241 and 244 reliably contact the reference surfaces 141 and 144, which are located at the front side and the rear side of the left sidewall 3L. Thus, the photosensitive member unit 90 can be further accurately positioned in the predetermined position in the width direction. Specifically, the risk of the photosensitive drums 71K-71C inclining with respect to the centerline of the sheet conveying path P or the sheet conveying surface 33A in the front-rear direction can be reduced or parallel displacement of the photosensitive drums 71K-71C with respect to the centerline of the sheet conveying path P or the sheet conveying surface 33A in the front-rear direction can be reduced. With the above configuration, an urging force of each of the main body-side electrodes 101-112 can be reduced. As the main body-side electrodes 101-112 do not excessively press the photosensitive member unit 90, the photosensitive member unit 90 can move smoothly along the placement paths D1-D3 while reducing the sway in the width direction.

According to the printer 1, the main body-side electrodes 101-112 apply a force in the width direction to the photosensitive member unit 90 when the photosensitive member unit 90 is in the placement paths D1 and D2. Specifically, the main body-side electrodes 101-112 are configured to start to apply a force to the photosensitive member unit 90 at an early stage of movement along the placement paths D1 and D2. With this configuration, the photosensitive member unit 90 can be prevented from swaying in the width direction during movement along the placement paths D1 and D2, which allows the photosensitive member unit 90 to move smoothly. In addition, the placement paths D1-D3 include bending portion. Compared with a straight path, the placement paths D1-D3 can contribute size reduction of the printer 1.

In the printer 1, the cam plate 410, the support holes 411, and the locking member 500, which are disposed in the main body 3, forms a lift mechanism. When the photosensitive member unit 90 moves from the operational position toward the removable position along the third path D3, the lift mechanism lifts the front side of the photosensitive member unit 90. When the photosensitive member unit 90 moves from the removable position to the operational position along the third path D3, the lift mechanism lowers the photosensitive member unit 90 to the operational position while pressing the front side of the photosensitive member unit 90 rearward. When the lift mechanism lowers the photosensitive member unit 90 to the operational position, the second inclined surface 517 presses the support shaft 95 downward, and the photosensitive member unit 90 is hard to move in the width direction.

According to the printer 1, the main body-side electrodes 101-112 are configured to apply the force in the width direction to the photosensitive member unit 90 since when the photosensitive member unit 90 passes halfway in the path D1, so as to cause the positioning protrusions 241-244 to approach the reference surfaces 141-144 in the width direction before the second inclined surface 517 presses the support shaft 95 downward or before the photosensitive member unit 90 reaches the operational position. With this configuration, the reference surfaces 141-144 can reliably position the photosensitive member unit 90 in the predetermined position, unaffected by the lift mechanism.

Instead of the force transmitting devices 131-138 and the force receiving devices 231-238, gears, e.g., helical gears, may be used. When a helical gear as a force transmitting device rotates to drive a helical gear as a force receiving device during image formation, a force in the width direction easily acts from the force transmitting device to the force receiving device. However, the main body-side electrodes 101-112 apply a force in the width direction to the photosensitive member unit 90 even during image formation, which may reduce a tendency to displace the photosensitive member unit 90 in the width direction due to rotation of the helical gears.

The second path D2 may be omitted and the lift-up mechanism may be configured to move the photosensitive member unit 90 from the end of the first path D1 to the operational position shown in FIG. 1. With this configuration, the printer 1 may be made thin.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the embodiment and examples of modifications disclosed herein are merely illustrative. It is to be understood that the scope of the invention is not to be so limited thereby, but is to be determined by the claims which follow.

What is claimed is:

1. An electrophotographic image forming apparatus comprising:

a main body defining a sheet conveying path in which a recording sheet is conveyed, the main body including:

a first wall and a second wall disposed opposite the first wall, the first wall including a reference surface;

a force transmitting device configured to transmit a drive force;

a pressing device disposed opposite the reference surface of the first wall;

a cover attached to the main body, the cover being configured to pivot between an open position and a closed position; and a photosensitive member unit configured to move between an operational position in which the photosensitive member unit is stored in the main body and an image is ready to be formed and an outer position in which a portion of the photosensitive member unit extends out of the main body, the photosensitive member unit including:

a first side frame facing the first wall of the main body when the photosensitive member unit is in the operational position;

a second side frame facing the second wall of the main body when the photosensitive member unit is in the operational position;

a plurality of photosensitive members each extending between the first and second side frames and arranged in tandem between the first and second side frames, each of the photosensitive members being configured to carry a toner image thereon; and a force receiving device disposed in the first side frame, the force receiving device being configured to engage the force transmitting device when the photosensitive member unit is in the operational position, and to receive the drive force from the force transmitting device;

wherein when the photosensitive member unit moves from the outer position toward the operational position, the photosensitive member unit stops at a particular position located between the outer position and the operational position, wherein the reference surface of the first wall of the main body contacts the photosensitive member unit located in the operational position, wherein the pressing device of the main body is configured to press the photosensitive member unit toward the reference surface when the photosensitive member unit is located in the operational position, and wherein when the cover pivots from the open position to the closed position, the photosensitive member unit moves from the particular position, located between the outer position and the operational position, to the operational position.

2. The image forming apparatus according to claim 1, wherein the main body further includes a supporting member that is configured to support the pressing device, wherein the photosensitive member unit further includes a receiving portion that is configured to receive the pressing device, and wherein, when the photosensitive member unit moves from the particular position to the operational position, a distance between the supporting member and the receiving portion becomes small.

3. The image forming apparatus according to claim 1, wherein a distance between the outer position and the particular position is larger than a distance between the operational position and the particular position.

4. The image forming apparatus according to claim 1, wherein the main body further includes a reference protrusion protruding from the first wall and having the reference surface, wherein the first side frame of the photosensitive member unit includes an opposing protrusion having an opposing surface, wherein when the photosensitive member unit is in the particular position, the opposing surface of the opposing protrusion is located away from the reference surface of the reference protrusion, and wherein when the photosensitive member unit is in the operational position, the opposing surface of the opposing protrusion contacts the reference surface of the reference protrusion.

5. The image forming apparatus according to claim 4, wherein the reference protrusion further includes an inclined surface, and the inclined surface is configured to guide the opposing protrusion during movement of the photosensitive member unit between the operational position and the particular position.

6. The image forming apparatus according to claim 4, wherein the reference protrusion further includes an inclined surface, wherein the opposing protrusion further includes an inclined surface, and wherein when the photosensitive member unit moves to the operational position, the inclined surface of the reference protrusion contacts the inclined surface of the opposing protrusion.

7. The image forming apparatus according to claim 1, wherein the photosensitive member unit further includes a pair of first and second cam followers protruding to the first and second walls respectively, and wherein when the photosensitive member unit is located in the operational position, the first wall and an end of the first cam follower close to the first wall define a first gap therebetween, and the second wall and an end of the second cam follower close to the second wall define a second gap therebetween.

8. The image forming apparatus according to claim 1, wherein the main body includes a pair of guide portions disposed on the first wall and the second wall respectively, and the guide portions are configured to guide the photosensitive member unit between the operational position and the outer position.

9. The image forming apparatus according to claim 8, wherein the photosensitive member unit further includes a pair of cam followers protruding to the first wall and the second wall respectively, and wherein the guide portions are configured to guide the cam followers.

10. The image forming apparatus according to claim 8, wherein each of the guide portions has a first guide surface and a second guide surface that is inclined with respect to the first guide surface, and wherein the pressing device presses the photosensitive member unit toward the reference surface when the photosensitive member unit is located on the second guide surface.

11. The image forming apparatus according to claim 10, wherein the second guide surface extends in a downward direction crossing the first guide surface.

12. The image forming apparatus according to claim 1, wherein the photosensitive member unit further includes a unit-side electrode disposed in the second side frame, and the unit-side electrode is electrically connected to an element of the photosensitive member unit, and wherein the pressing device of the main body includes a main body-side electrode disposed in the second wall, and the main body-side electrode is configured to contact the unit-side electrode when the photosensitive member unit is located in the operational position and to supply electricity to the element of the photosensitive member unit.

13. The image forming apparatus according to claim 1, wherein the photosensitive member unit further includes a plurality of unit-side electrodes disposed in the second side frame, and the unit-side electrodes are electrically connected to elements of the photosensitive member unit, and wherein the pressing device of the main body includes a plurality of main body-side electrodes disposed in the second wall, and the main body-side electrodes are configured to contact the unit-side electrodes when the photosensitive member unit is located in the operational position and to supply electricity to the elements of the photosensitive member unit.

14. The image forming apparatus according to claim 1, wherein the main body further includes a lift mechanism configured to lift the photosensitive member unit when the photosensitive member unit moves from the particular position to the outer position, and to lower the photosensitive member unit when the photosensitive member unit moves from the particular position to the operational position.

15. The image forming apparatus according to claim 1, wherein the operational position of the photosensitive member unit is shifted in a slanting direction with respect to the particular position of the photosensitive member unit.

16. The image forming apparatus according to claim 15, wherein the photosensitive member unit moves straightly between the operational position and the particular position.

17. The image forming apparatus according to claim 15, wherein the main body further includes a guide having a guide surface, and the guide surface contacts and guides a portion of the photosensitive member unit when the photosensitive member unit moves between the operational position and the particular position.

18. The image forming apparatus according to claim 1, wherein the photosensitive member unit includes a developing roller.

19. The image forming apparatus according to claim 1, wherein when the cover pivots from the open position to the closed position, the first wall and the second wall of the main body remain stationary.

20. The image forming apparatus according to claim 1, wherein the second wall of the main body has an opening, and wherein the pressing device of the main body includes a contact portion and a coil spring portion connected to the contact portion, and the contact portion protrudes from the opening of the second wall.

21. An image forming apparatus comprising:

a main body defining a sheet conveying path in which a recording sheet is conveyed, the main body including:

a first wall and a second wall disposed opposite the first wall, the first wall including a plurality of reference surfaces;

a plurality of force transmitting devices configured to transmit a drive force;

a plurality of pressing devices disposed opposite to the reference surfaces of the first wall; and a cover attached to the main body, the cover being configured to pivot between an open position and a closed position; and a photosensitive member unit configured to move between an operational position in which the photosensitive member unit is stored in the main body and an image is ready to be formed and an outer position in which a portion of the photosensitive member unit extends out of the main body, the photosensitive member unit including:

a first side frame facing the first wall of the main body when the photosensitive member unit is in the operational position;

a second side frame facing the second wall of the main body when the photosensitive member unit is in the operational position;

a plurality of photosensitive members each extending between the first and second side frames and arranged in tandem between the first and second side frames, each of the photosensitive members being configured to carry a toner image thereon; and a plurality of force receiving devices disposed in the first side frame, the force receiving devices being configured to engage the force transmitting devices when the photosensitive member unit is in the operational position, and to receive the drive force from the force transmitting devices;

wherein when the photosensitive member unit moves from the outer position toward the operational position, the photosensitive member unit stops at a particular position located between the outer position and the operational position, wherein the reference surfaces of the first wall of the main body contact the photosensitive member unit located in the operational position, wherein the pressing devices of the main body are configured to press the photosensitive member unit toward the reference surfaces when the photosensitive member unit is located in the operational position, and wherein when the cover pivots from the open position to the closed position, the photosensitive member unit moves from the particular position, located between the outer position and the operational position, to the operational position.

22. The image forming apparatus according to claim 21, wherein the operational position of the photosensitive member unit is shifted in a slanting direction with respect to the particular position of the photosensitive member unit.

23. The image forming apparatus according to claim 22, wherein the photosensitive member unit moves straightly between the operational position and the particular position.

24. The image forming apparatus according to claim 22, wherein the main body further includes a guide having a guide surface, and the guide surface contacts and guides a portion of the photosensitive member unit when the photosensitive member unit moves between the operational position and the particular position.

25. The image forming apparatus according to claim 21, wherein the photosensitive member unit includes a developing roller.

26. The image forming apparatus according to claim 21, wherein when the cover pivots from the open position to the closed position, the first wall and the second wall of the main body remain stationary.

27. The image forming apparatus according to claim 21, wherein the second wall of the main body has an opening, and wherein the pressing device of the main body includes a contact portion and a coil spring portion connected to the contact portion, and the contact portion protrudes from the opening of the second wall.

28. An electrophotographic image forming apparatus comprising:

a main body defining a sheet conveying path in which a recording sheet is conveyed, the main body including:

a first wall and a second wall disposed opposite the first wall, the first wall including a reference surface;

a force transmitting device configured to transmit a drive force;

a pressing device disposed opposite the reference surface; and a stopper; and a photosensitive member unit configured to move between an operational position in which the photosensitive member unit is stored in the main body and an image is ready to be formed, a particular position between the operational position and an outer position, and the outer position in which a portion of the photosensitive member unit extends out of the main body, the photosensitive member unit including:

a first side frame facing the first wall of the main body when the photosensitive member unit is in the operational position;

a second side frame facing the second wall of the main body when the photosensitive member unit is in the operational position;

a plurality of photosensitive members each extending between the first and second side frames and arranged in tandem between the first and second side frames, each of the photosensitive members being configured to carry a toner image thereon;

a force receiving device disposed in the first side frame, the force receiving device being configured to engage the force transmitting device when the photosensitive member unit is in the operational position, and to receive the drive force from the force transmitting device; and a passing member configured to be stopped by the stopper of the main body when the photosensitive member unit is in the particular position;

wherein the reference surface of the first wall of the main body contacts the photosensitive member unit located in the operational position, wherein the pressing device of the main body is configured to press the photosensitive member unit toward the reference surface when the photosensitive member unit is located in the operational position, wherein the stopper stops the passing member when the photosensitive member unit is located in the particular position, and wherein the stopper releases stopping of the passing member when the photosensitive member unit moves from the particular position to the operational position.

29. The image forming apparatus according to claim 28, wherein the passing member includes a shaft.

30. The image forming apparatus according to claim 28, wherein the stopper includes a surface and a movable member configured to move with respect to the surface, wherein the passing member is stopped by the surface and the movable member of the stopper when the photosensitive member unit is in the particular position, and wherein when the photosensitive member unit moves from the particular position to the operational position, the movable member moves in a direction away from the surface and the passing member is released from the surface and the movable member.

31. The image forming apparatus according to claim 28, wherein the main body further includes a cover attached to the main body, and the cover is configured to pivot between an open position and a closed position, and wherein when the cover pivots from the open position to the closed position, the stopper releases the stopping of the passing member and the photosensitive member unit moves to the operational position.

32. The image forming apparatus according to claim 28, wherein the operational position of the photosensitive member unit is shifted in a slanting direction with respect to the particular position of the photosensitive member unit.

* * * * *